US008555422B2

(12) United States Patent
Steele

(10) Patent No.: US 8,555,422 B2
(45) Date of Patent: Oct. 15, 2013

(54) MALE UNDERGARMENT INCLUDING SUPPORTING STRUCTURES

(76) Inventor: Tyrone Steele, Ashburn, VA (US)

( * ) Notice: Subject to any disclaimer, the term of this patent is extended or adjusted under 35 U.S.C. 154(b) by 0 days.

(21) Appl. No.: 13/267,983

(22) Filed: Oct. 7, 2011

(65) Prior Publication Data

US 2012/0260404 A1 Oct. 18, 2012

Related U.S. Application Data

(60) Provisional application No. 61/517,013, filed on Apr. 13, 2011.

(51) Int. Cl.
*A41B 9/02* (2006.01)

(52) U.S. Cl.
USPC ..... 2/403; 2/400

(58) Field of Classification Search
USPC ..... 2/400–405, 238; 602/67
See application file for complete search history.

(56) References Cited

U.S. PATENT DOCUMENTS

| | | | | | |
|---|---|---|---|---|---|
| 602,188 | A | * | 4/1898 | Sittig | 2/238 |
| 833,849 | A | | 10/1906 | Schiff | |
| 1,052,765 | A | | 2/1913 | Strauss | |
| 1,083,712 | A | * | 1/1914 | Uyeda | 2/408 |
| 1,265,089 | A | * | 5/1918 | Kenzy | 602/68 |
| 1,404,855 | A | | 1/1922 | Heilmann | |
| 1,512,171 | A | | 10/1924 | Homling | |
| 1,861,383 | A | | 5/1932 | Ficcio | |
| 2,012,879 | A | * | 8/1935 | Kneibler | 2/403 |
| 2,033,266 | A | | 3/1936 | Hunt Vinyard Truitt | |
| 2,033,551 | A | * | 3/1936 | Mae | 602/73 |
| 2,235,849 | A | * | 3/1941 | Reis | 2/234 |
| 2,323,842 | A | | 7/1943 | Rakauskas | |
| 2,328,953 | A | | 9/1943 | Chatfield et al. | |
| 2,336,248 | A | * | 12/1943 | Harwood | 2/403 |
| 2,369,773 | A | * | 2/1945 | Simon | 2/403 |
| D160,328 | S | | 10/1950 | Marks | |
| 2,601,602 | A | * | 6/1952 | Firsching, Sr. | 602/67 |
| D179,937 | S | | 3/1957 | Fenlason | |
| 2,872,685 | A | * | 2/1959 | Denbo | 2/403 |
| 3,207,155 | A | * | 9/1965 | Cullen | 602/67 |
| 3,250,273 | A | | 5/1966 | Loeffel et al. | |
| 3,788,314 | A | * | 1/1974 | Noreen | 602/67 |
| 3,844,282 | A | * | 10/1974 | King | 602/67 |
| 3,974,836 | A | * | 8/1976 | Carlson | 450/102 |
| 4,014,044 | A | * | 3/1977 | Figueroa et al. | 2/466 |
| 4,195,630 | A | * | 4/1980 | Connery et al. | 602/67 |
| 4,377,008 | A | * | 3/1983 | Jung | 2/403 |
| D268,454 | S | | 4/1983 | Novo | |

(Continued)

OTHER PUBLICATIONS

Notice of Allowability mailed Apr. 3, 2012 in corresponding Design Patent Application No. 29/406,018—Including p. 1 of Notice of Allowability and two pages of References Cited.

(Continued)

*Primary Examiner* — Richale Quinn
(74) *Attorney, Agent, or Firm* — Symbus Law Group, LLC; Clifford D. Hyra

(57) ABSTRACT

A male undergarment, including at least one enclosing panel, a cover panel, disposed substantially at the front of the undergarment, and a separation panel disposed interiorly of the cover panel, wherein the cover panel has a portion thereof selectively attachable to a portion of the undergarment, and a portion thereof coupled to the at least one enclosing panel, and the separation panel has an opening defined therein.

20 Claims, 8 Drawing Sheets

(56) References Cited

U.S. PATENT DOCUMENTS

| | | | | |
|---|---|---|---|---|
| 4,389,733 | A * | 6/1983 | Boykins, Jr. | 2/466 |
| 4,555,245 | A | 11/1985 | Armbruster | |
| D282,212 | S | 1/1986 | Langmyr | |
| 4,637,078 | A * | 1/1987 | Southwell | 2/408 |
| 4,660,554 | A | 4/1987 | Wright | |
| 4,759,355 | A * | 7/1988 | Thrower | 602/67 |
| 4,870,958 | A | 10/1989 | Webster | |
| 4,961,419 | A | 10/1990 | Tribble et al. | |
| 5,029,345 | A * | 7/1991 | Angheluta et al. | 2/403 |
| 5,070,869 | A | 12/1991 | Zhang | |
| 5,226,179 | A | 7/1993 | Choi | |
| D339,219 | S | 9/1993 | Beauchemin | |
| 5,274,854 | A | 1/1994 | Wenner et al. | |
| D348,102 | S | 6/1994 | Gegelys et al. | |
| D353,933 | S | 1/1995 | Michels | |
| D362,950 | S | 10/1995 | Molino | |
| 5,539,926 | A * | 7/1996 | Mantos | 2/23 |
| 5,607,412 | A | 3/1997 | Brown | |
| D378,947 | S | 4/1997 | Desmond | |
| 5,636,387 | A | 6/1997 | Lundy | |
| 5,647,065 | A * | 7/1997 | Richerson | 2/403 |
| D389,289 | S | 1/1998 | Law | |
| D398,055 | S | 9/1998 | Burden | |
| 5,870,779 | A | 2/1999 | Heron | |
| 5,875,495 | A * | 3/1999 | Thrower | 2/403 |
| 6,014,777 | A * | 1/2000 | Gupton | 2/400 |
| 6,018,822 | A | 2/2000 | Hernandez | |
| 6,041,441 | A * | 3/2000 | Counts et al. | 2/227 |
| D423,188 | S | 4/2000 | Raffali | |
| D444,616 | S | 7/2001 | Khan | |
| D445,239 | S | 7/2001 | Harris | |
| 6,295,651 | B1 | 10/2001 | Kang | |
| 6,412,119 | B1 * | 7/2002 | Robles | 2/400 |
| 6,425,140 | B1 * | 7/2002 | Vitches | 2/403 |
| 6,565,548 | B1 | 5/2003 | Glaug et al. | |
| 6,662,378 | B2 | 12/2003 | Vartanyan | |
| D494,738 | S | 8/2004 | Kirkup | |
| D506,303 | S * | 6/2005 | Rocha | D2/742 |
| 6,901,607 | B1 | 6/2005 | Elwell | |
| D509,945 | S | 9/2005 | Ogle | |
| 38,930 | A1 * | 1/2006 | Chong | 2/403 |
| D513,658 | S | 1/2006 | Langmyr | |
| 7,024,703 | B1 * | 4/2006 | Della Ratta | 2/403 |
| D521,711 | S | 5/2006 | Langmyr | |
| D528,266 | S | 9/2006 | Langmyr | |
| D529,260 | S | 10/2006 | Langmyr | |
| D530,485 | S | 10/2006 | Langmyr | |
| D537,236 | S | 2/2007 | Langmyr | |
| D538,508 | S | 3/2007 | Langmyr | |
| D539,507 | S | 4/2007 | Langmyr | |
| 7,434,273 | B2 * | 10/2008 | Chung | 2/403 |
| D590,129 | S | 4/2009 | Warman | |
| D603,582 | S * | 11/2009 | Fennell | D2/712 |
| 7,788,739 | B1 * | 9/2010 | Della Ratta | 2/403 |
| D628,517 | S * | 12/2010 | Bitzan | D11/221 |
| D651,377 | S | 1/2012 | Weaver et al. | |
| 8,087,098 | B2 | 1/2012 | Kimberly et al. | |
| D660,551 | S * | 5/2012 | Steele | D2/712 |
| 2004/0025218 | A1 * | 2/2004 | Huang | 2/73 |
| 2006/0277649 | A1 * | 12/2006 | Smith | 2/69 |
| 2007/0277285 | A1 * | 12/2007 | Gravette et al. | 2/78.1 |
| 2008/0114327 | A1 | 5/2008 | Barge | |
| 2009/0106874 | A1 | 4/2009 | Shlush | |
| 2011/0023216 | A1 | 2/2011 | O'Leary | |

OTHER PUBLICATIONS

Notice of Allowability mailed Apr. 4, 2012 in corresponding Design Patent Application No. 29/406,019—Including p. 1 of Notice of Allowability and two pages of References Cited.

* cited by examiner

MALE UNDERGARMENT INCLUDING SUPPORTING STRUCTURES

RELATED APPLICATIONS

This application claims priority under 35 U.S.C. 119(e) to U.S. Provisional Patent Application No. 61/517,013 filed Apr. 13, 2011, the disclosure of which is incorporated by reference herein in its entirety.

BACKGROUND

Conventional men's undergarments have many known setbacks. Most notably, conventional men's undergarments do not always provide sufficient comfort, support, air circulation or sweat prevention for the male genitals. Due to the close proximity of the male genitals to the thighs, the groin frequently becomes overheated, raising the ambient temperature of the genitals and the surrounding area. This elevated ambient temperature, in combination with the resulting perspiration, may cause chaffing, jock itch, discomfort, skin conditions or some serious medical conditions. Further, conventional men's undergarments do not always provide adequate support to the genitals, exacerbating the discomfort of conventional underwear.

Another drawback of conventional underwear is that conventional underwear must be removed in order to allow the wearer to relieve himself. In certain situations, such as when an athlete competing in a triathlon needs to relieve himself, this is less than ideal. Instead, it would be preferable to have underwear that would easily allow the wearer to expose his genitals and relieve himself. While solutions to this problem have been introduced to the market, there is still a need for comfortable underwear which provides adequate comfort and support while simultaneously allowing the user to remove his genitals from the underwear without taking off his underwear.

SUMMARY

According to at least one exemplary embodiment, a male undergarment may be disclosed. The undergarment can include at least one enclosing panel, a cover panel, disposed substantially at the front of the undergarment, and a separation panel disposed interiorly of the cover panel, wherein the cover panel has a portion thereof selectively attachable to a portion of the undergarment, and a portion thereof coupled to the at least one enclosing panel, and the separation panel has an opening defined therein.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1A:
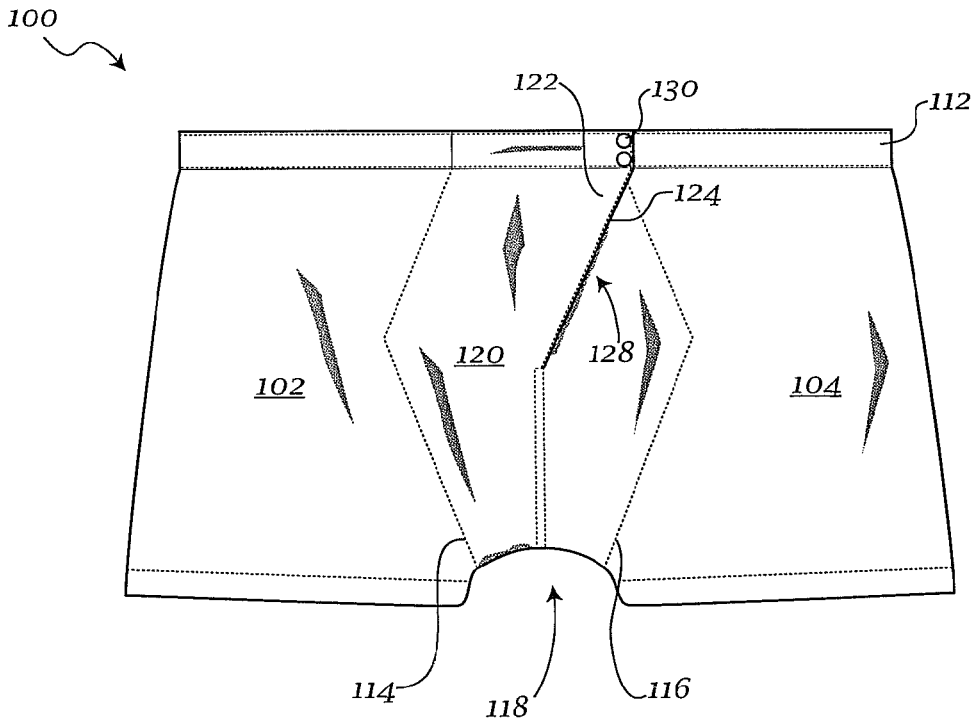
FIG. 1*a* shows a front view of a first exemplary embodiment of a male undergarment.

Aspects of the invention disclosed in the following description and related drawings are directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Referring generally to FIGS. 1*a*-4*c*, exemplary embodiments of a men's undergarment may be disclosed. The undergarment can provide a separate section for the genitals, such that they are separated from the rest of the body by fabric. Further, the present invention may have a removable cover portion allowing the genitals to be quickly exposed, if, for example, the wearer must quickly relieve himself. The undergarment may be sewn together from multiple fabric cut patterns and may include overlapping front panels, wherein the inner panel may be a separation panel and the outer panel may be the aforementioned removable cover panel. The separation panel may contain an opening and allow the genitals to be inserted into the exterior section of the undergarment. The interior section may fit snugly around the upper thighs, hips and buttocks, and may be secured by an elastic waistband. Alternately, the interior section may be a loosely fitting garment, wherein the garment may be secured around the waist or hips and hang loosely over the wearer's legs.

The genitals may be inserted into the aforementioned exterior section through an opening in the separation panel, and may be secured in this exterior section in order to provide the wearer with support and comfort. This separation may be facilitated by providing a hole which does not allow the genitals to reenter the main compartment of the underwear and instead only allows the genitals to be in contact with the fabric panels of the front flap and the separation panel. This fabric enclosure may decrease the temperature and perspiration which occurs in, on and around the genitals in conventional men's undergarments. It is intended that the genitals shall remain cool and dry so that the wearer does not experience discomfort and the above-noted repercussions associated with such discomfort.

On the whole, the undergarment may include at least one enclosing panel, a cover panel and a separation panel. Generally, the undergarment may be manufactured by coupling at least one enclosing panel with the cover panel and separation panel so as to create a tubular encasing, with the cover panel and separation panel oriented proximate the genitalia of the user. The separation panel may include an opening sized and positioned to comfortably receive the user's genitalia therethrough. The undergarment may further include a waistband. The separation panel may have a substantially similar shape to the cover panel, and may be disposed interiorly of the cover panel.

Still referring generally to FIGS. 1*a*-4*c*, the figures may depict four different exemplary embodiments of the undergarment, but it is envisioned that the undergarment may feature any combination of features, while including overlapping front panels, which may include a separation fabric panel and a cover panel. Generally, FIGS. 1*a*-1*d* may show an exemplary boxer brief embodiment of the men's undergarment which may utilize an annular opening in the separation panel, as well as snaps, buttons and the like, to secure the front flap of the undergarment in place. In contrast, FIGS. 2*a*-2*d* may show an exemplary compression short embodiment of the undergarment which may likewise utilize an annular opening, and may further include a zipper or Velcro mechanism in order to secure the front flap to the underwear base, in lieu of the snaps, buttons, or the like of the embodiment of FIGS. 1*a*-1*c*. FIGS. 3*a*-4*c*, on the other hand, may depict two exemplary briefs embodiments of the undergarments. While both embodiments may utilize a vertical opening, FIGS. 3*a*-3*c* may utilize a snap, button or similar arrangement to secure the front flap in place while FIGS. 4*a*-4*c* may utilize a zipper, Velcro, or similar arrangement to secure the front flap in place.

Figure 1B:
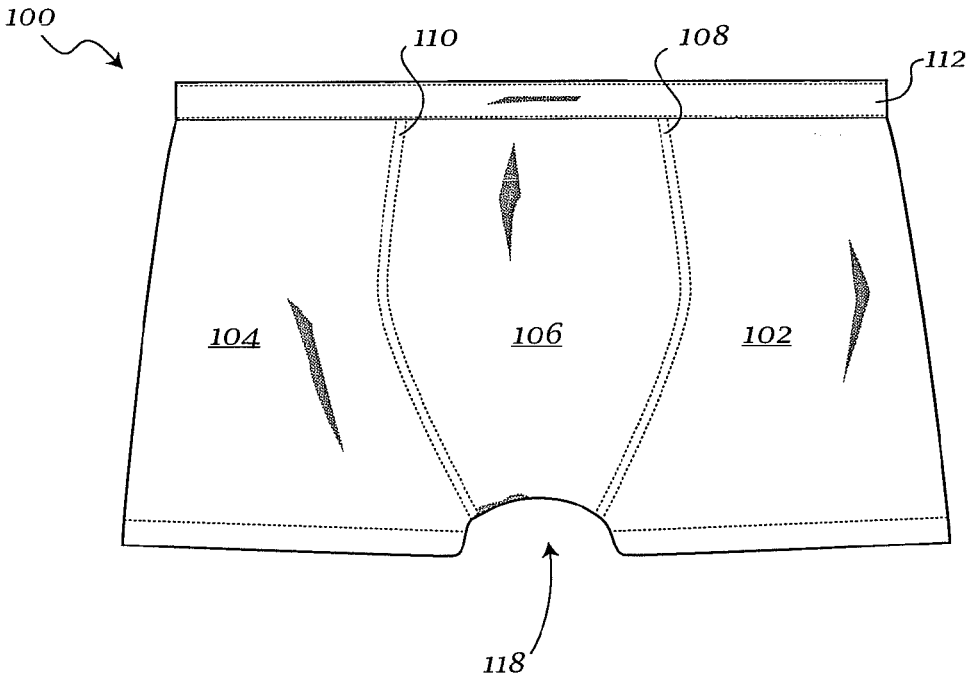
FIG. 1*b* shows a rear view of a first exemplary embodiment of a male undergarment.

Referring now to FIGS. 1*a*-1*b*, in one exemplary embodiment, underwear 100 may be a boxer brief. Underwear 100 may include a plurality of fabric panels 102, 104, 106. In the exemplary embodiment shown in FIGS. 1*a*-1*b*, first side panel 102 and second side panel 104 each may form the sides of underwear 100. A rear panel 106 may be disposed at the rear of underwear 100 between first and second side panels 102, 106. As shown in FIG. 1*b*, first side panel 102 may be attached to rear panel 106 along a side of rear panel 106. Coupling between first and rear panels 102 and 106 may be facilitated by a first rear seam 108. Similarly, the opposite side of rear panel 106 may, in turn, be affixed to second side panel 104. Coupling between second and third panels 104 and 106 may be facilitated by a second rear seam 110. Rear panel 106 may be shaped such that the width of rear panel 106 is greatest substantially midway between the top edge of the rear panel and the crotch area 118, as shown in FIG. 1*b*. The width of rear panel 106 may decrease with increasing proximity to crotch area 118. The top edges of first side panel 102, second side panel 104, and rear panel 106 may further be affixed to an edge of waistband 112.

It is envisioned that undergarment 100 may be fabricated from any type of fabric suitable for underwear, including, but not limited to, nylon, cotton, spandex, linen, silk, or a combination thereof. Similarly, it is also envisioned that waistband may be made from any of the aforementioned fabrics, but waistband 112 may also include any elastic material or a tightening method, such as a drawstring or the like, such that the wearer may secure the undergarment 100 around his hips or waist in order to wear it. Further, it is envisioned that aforementioned panels may be affixed to each other or the waistband in any manner suitable for garment making, such as by sewing the panels together.

Figure 1C:
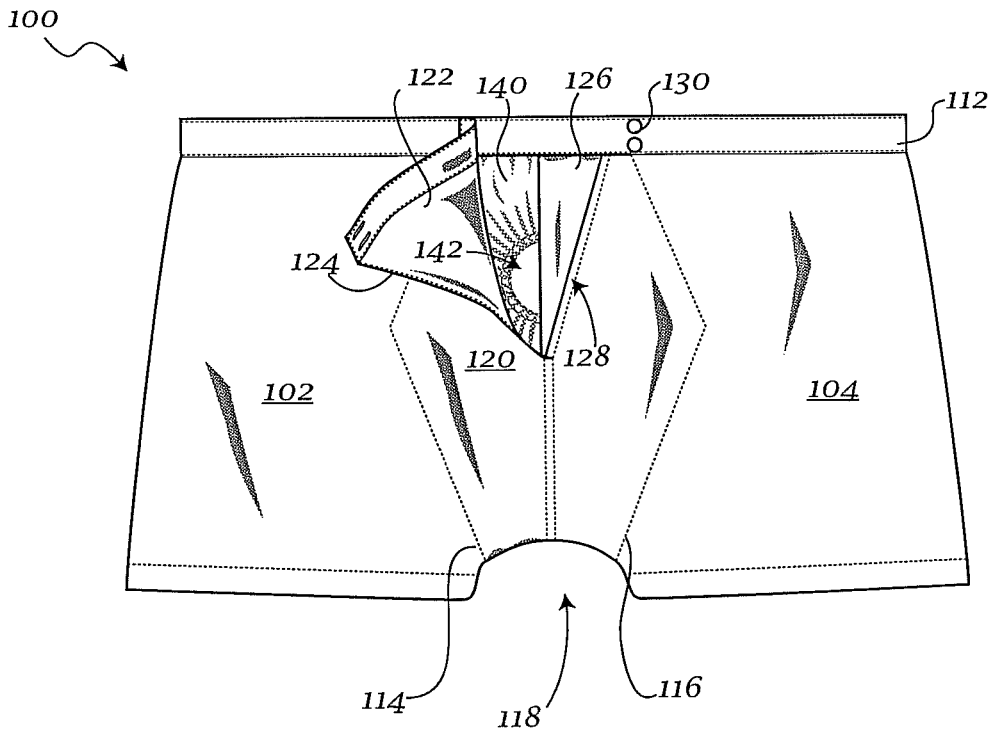
FIG. 1*c* shows a front view of a first exemplary embodiment of a male undergarment with the cover panel in an open configuration.

Now referring to FIGS. 1*a* and 1*c*, in one exemplary embodiment, cover panel 120 may be affixed to both first side panel 102 and second side panel 104. Coupling between first and cover panels 102, 120 may be facilitated by a first front seam 114, while coupling between second and cover panels 104, 120 may be facilitated by a second front seam 116. In the exemplary embodiment depicted in FIG. 1*a*, cover panel 120 may have a substantially hexagonal appearance, such that the width of cover panel 120 is greatest substantially midway between the top edge of the rear panel and the crotch area. The width of cover panel 120 can decrease with increasing proximity to crotch area 118 and to the top edge of cover panel 120.

Substantially above the midsection thereof, cover panel 120 may have a flap 122 defined therein. Flap 122 can have a top portion that can be removably affixed to waistband 112 by fasteners 130. A free edge 124 of flap 122 can extend substantially diagonally from substantially the midsection of cover panel 120 towards an upper corner of cover panel 120, and can overlap portion of cover panel 120. An additional privacy strip 126 may be coupled to cover panel 120 to provide additional overlap with flap 122.

Between flap 124 and cover panel 120 may be defined a slit 128. Slit 128 may be exposed when fasteners 130 are detached from waistband 112 and flap 122 is pulled back. As shown in FIGS. 1*a* and 1*c*, slit 128 may be an angular slit, but it is also envisioned that slit 128 may be of any shape and size and it may be located anywhere on cover panel 120. For example, slit 128 may be an L-shaped slit which runs along the side and top edges of flap 122. Similarly, it is envisioned that any number of any type of fastener, in any location, may be used as fasteners 130 provided that fasteners 130 may secure flap 122 to waistband 112, first side panel 102 or second side panel 104 when flap 122 is in a closed position. For example, fasteners 130 may include two snaps which secure an upper corner of flap 122 to waistband 112.

Figure 1D:
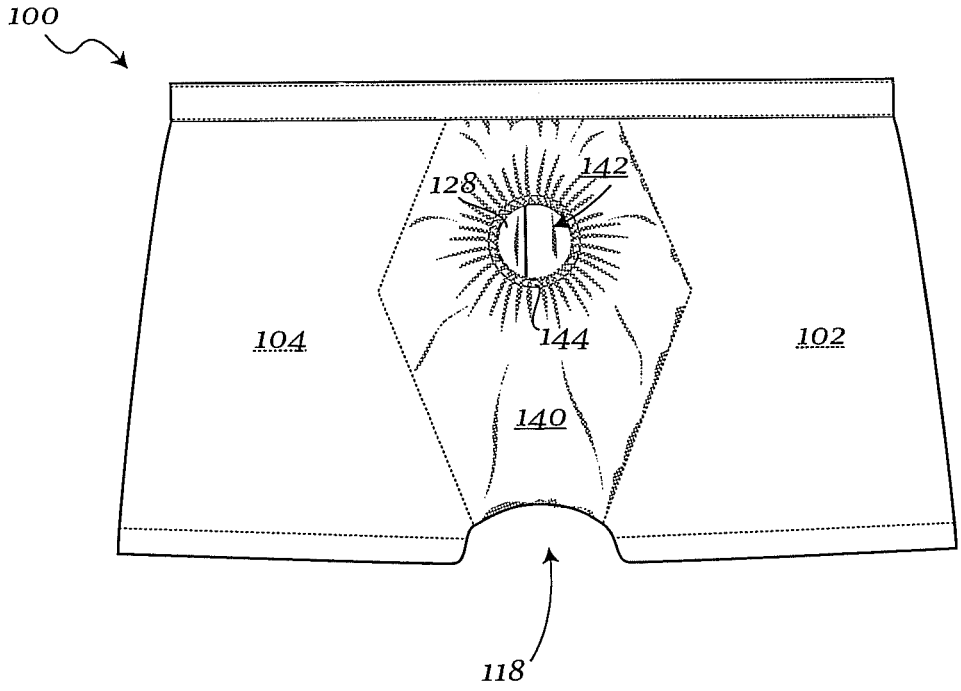
FIG. 1*d* shows an interior view of a first exemplary embodiment of a male undergarment.

In exemplary FIGS. 1*c*-1*d*, one exemplary version of a separation panel 140 is shown. Separation panel 140 may have a shape substantially similar to the shape of cover panel 120, and may be affixed to first side panel 102, second side panel 104 and waistband 112. Nevertheless, it is also envisioned that separation panel 140 may be removably affixed, partially affixed or not affixed to first side panel 102, second side panel 104 and waistband 112. Separation panel 140 may be formed from a material that can provide sufficient aeration therethrough; for example, a mesh-type material or the like. Such material may be different, if desired, from the material of the external panels 102, 104, 106, 120.

Separation panel 140 may further include an opening 142. Opening 142 may have a substantially annular shape and may be positioned such that, when undergarment 100 is worn, opening 142 can comfortably receive the genitalia of the user therethrough. Furthermore, opening 142 may be surrounded by an elastic band 144 to further provide support and comfort for the user. The material of separation panel 140 may further be gathered, or bunched, in the location of opening 142 so as to provide additional padding for the user. In other embodiments, opening 142 may have any desired shape or size that allows undergarment 100 to function as described herein.

In operation, the user may don undergarment 100 as commonly known. Subsequent to donning the undergarment, the user may insert the genitalia through opening 142. Separation panel 140 can thus function to provide sufficient separation between the body of the user and the genitalia, so as to increase aeration and reduce discomfort and moisture. Such functionality can be enhanced by the material of separation panel 140, which can be a mesh or otherwise porous or breathable material. The user can then detach flap 122 of cover panel 120 so as to expose the genitalia, if desired.

FIGS. 2*a*-2*d* show another exemplary embodiment of an undergarment 200, wherein the undergarment can be a compression short, and can be constructed from a suitable material, or any other desired material. The features of undergarment 200 that are substantially similar to the features of undergarment 100 are identified by similar numerals in the Figures. Such features should be understood to have substantially similar functionality, while the differences between undergarment 100 and undergarment 200 are further detailed below.

In the exemplary embodiment of undergarment 200, rear panel 206 may be shaped such that the width of rear panel 206 is greatest substantially near the top edge of rear panel 206. Rear panel 206 can further taper such that the width of rear panel 206 decreases with increasing proximity to crotch area 218. Similarly, the width of cover panel 220 can be greatest substantially proximate the top edge of cover panel 220, and can decrease with increasing proximity to crotch area 218. The contours of cover panel 220 can further be curved or undulating, or can have any other desired appearance.

Cover panel 220 of undergarment 200 can function as a flap, without requiring the provision of a separate flap as part of cover panel 220. To this end, cover panel 220 may be affixed to first side panel 202 substantially along the entirety of its edge, with the coupling being facilitated by first front seam 214. However, the top edge of cover panel 220 may be free, in that it is not affixed to any other portion of undergarment 200. Furthermore, the coupling between cover panel 220 and second side panel 204 may be facilitated by a fastener 230, such as, for example, at least one zipper. Furthermore, a lower portion of the coupling between cover panel 220 and second side panel 204 may be facilitated by second front seam 216. Fastener 230 may be concealed, or may have a configuration such that, when cover panel 220 is fastened to second side panel 204, the appearance of a continuous seam, rather than a fastener, is presented therebetween.

Figure 2A:
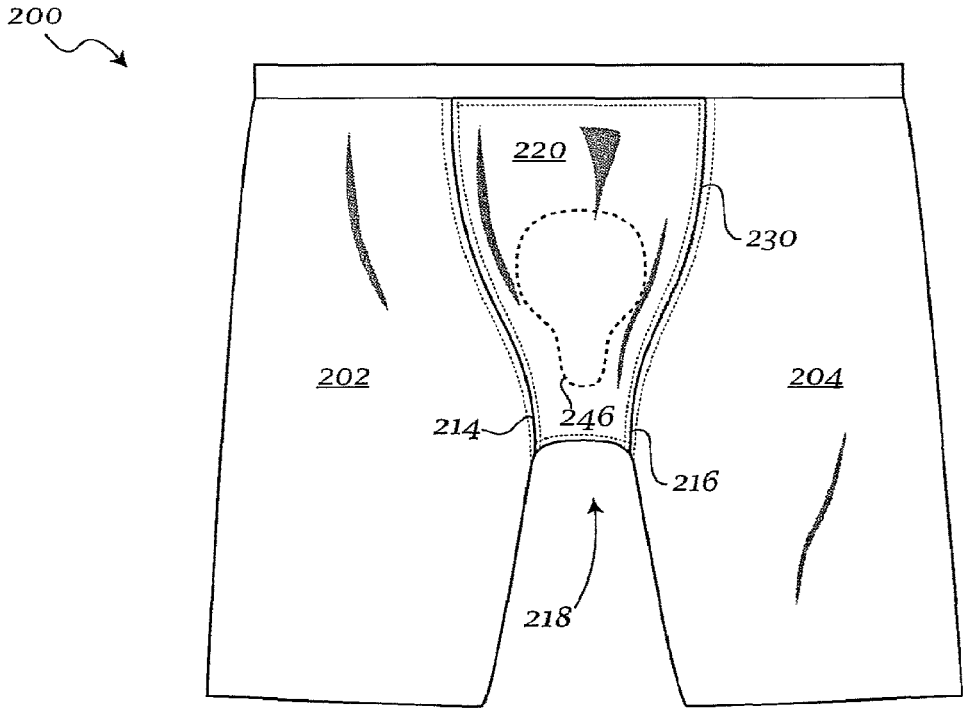
FIG. 2*a* shows a front view of a second exemplary embodiment of a male undergarment.
Figure 2B:
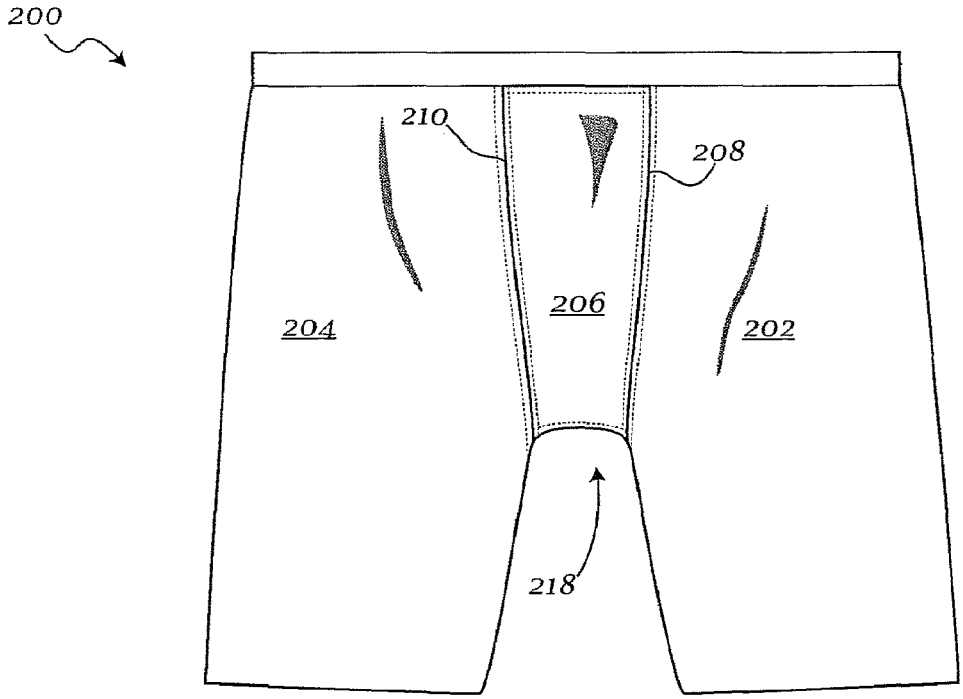
FIG. 2*b* shows a rear view of a second exemplary embodiment of a male undergarment.
Figure 2C:
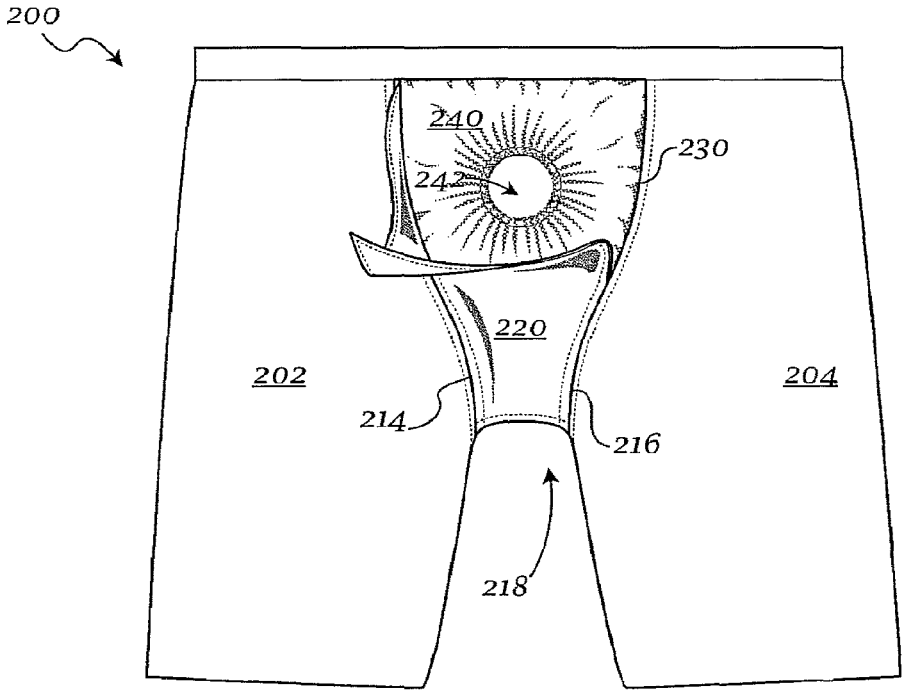
FIG. 2*c* shows a front view of a second exemplary embodiment of a male undergarment with the cover panel in an open configuration.
Figure 2D:
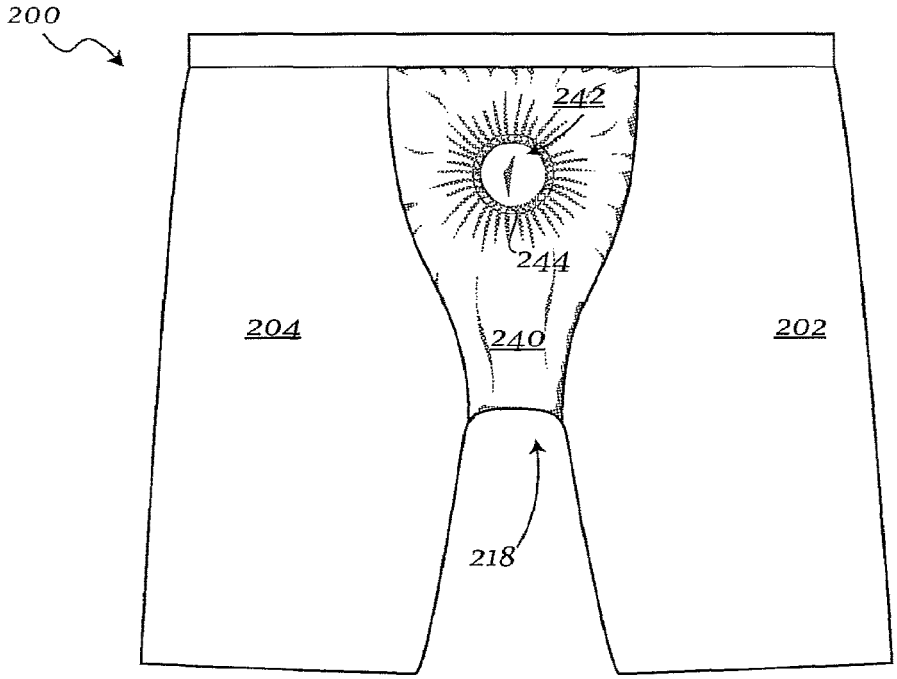
FIG. 2*d* shows an interior view of a second exemplary embodiment of a male undergarment.

Consequently, when fastener 230 is unfastened, the portion of the edge of cover panel 220 that is not coupled to second side panel 204 by second front seam 216 may be pulled back to expose separation panel 240 and opening 242, as shown in FIG. 2*c*. When fastener 230 is fastened, cover panel 240 can be disposed in the closed position, as shown in FIG. 2*a*.

Opening 242 may have a substantially annular shape and may be positioned such that, when undergarment 100 is worn, opening 242 can comfortably receive the genitalia of the user therethrough. Furthermore, opening 242 may be surrounded by an elastic band 244 to further provide support and comfort for the user. The material of separation panel 140 may further be gathered, or bunched, in the location of opening 242 so as to provide additional padding for the user. In other embodiments, opening 242 may have any desired shape or size that allows undergarment 200 to function as described herein.

A protective cup 246 may also be disposed between cover panel 220 and separation panel 240. Protective cup 246 may be coupled or partially coupled, if desired, to one or both of cover panel 220 and separation panel 240, while allowing undergarment 200 to function as described herein. Protective cup 246 may facilitate providing protection to the user's genitalia when the user is engaged in sports, such as, for example, football, baseball, soccer, and so forth.

Figure 3A:
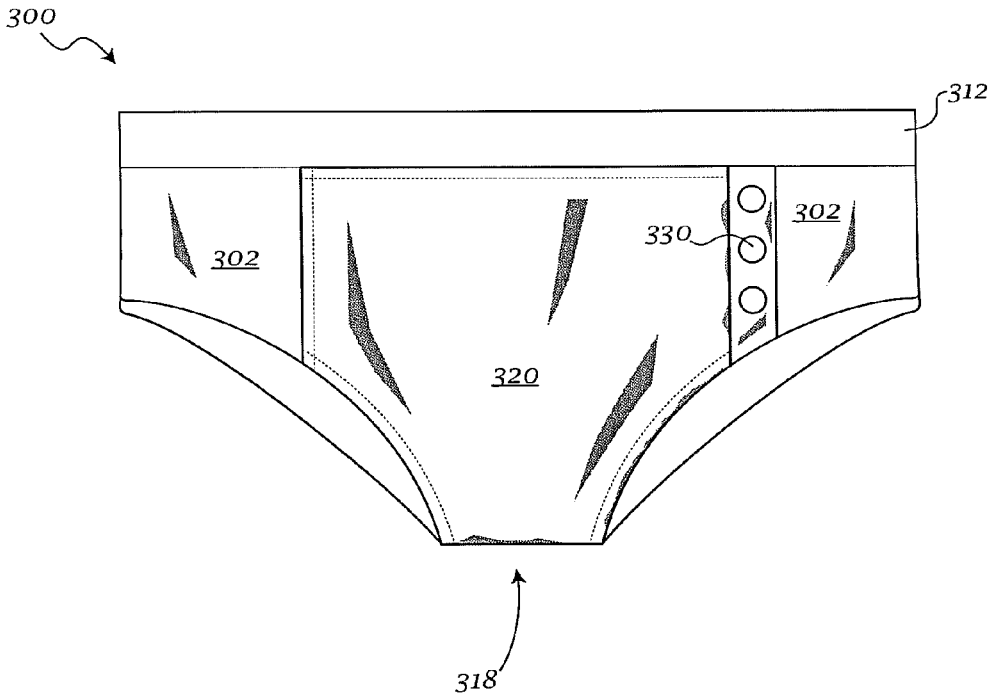
FIG. 3*a* shows a front view of a third exemplary embodiment of a male undergarment.
Figure 3B:
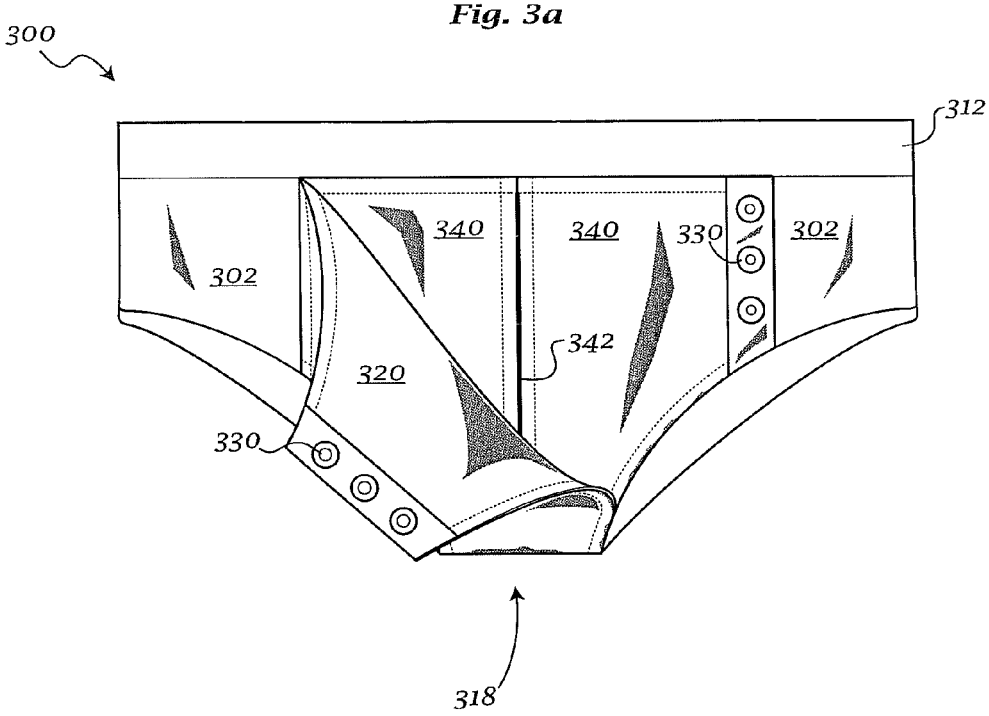
FIG. 3*b* shows a front view of a third exemplary embodiment of a male undergarment with the cover panel in an open configuration.
Figure 3C:
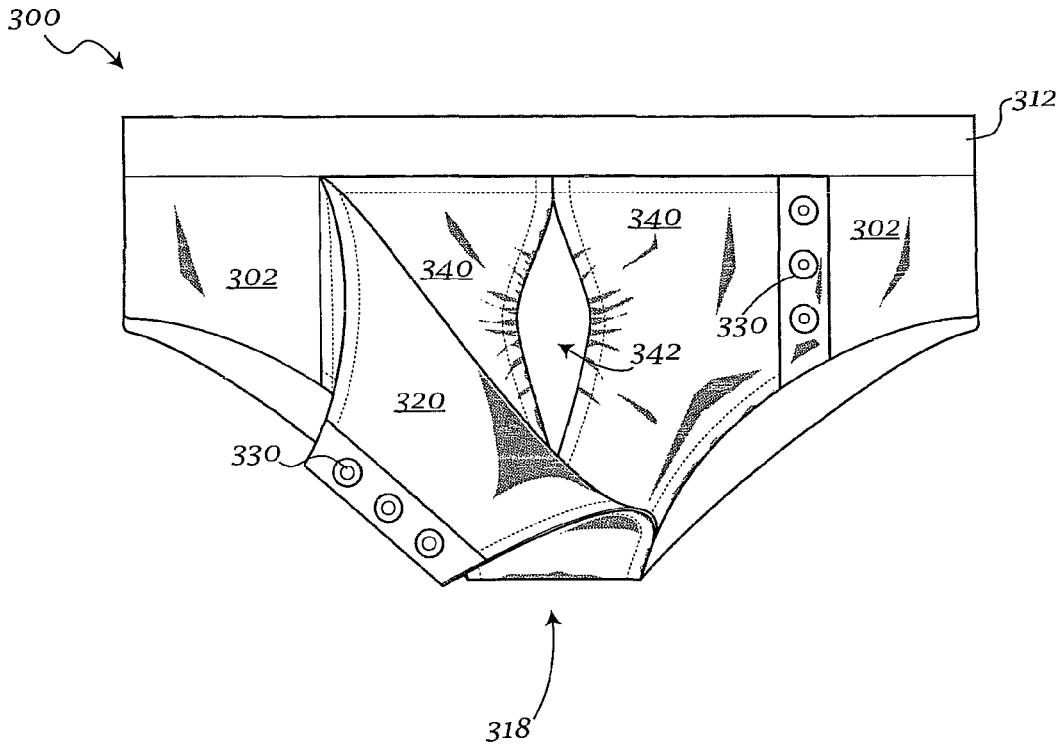
FIG. 3*c* shows a front view of a third exemplary embodiment of a male undergarment with the cover panel in an open configuration and the opening in an open configuration.

FIGS. 3*a*-3*c* show another exemplary embodiment of undergarment 300, which may be a brief-type undergarment, and may be formed from any suitable material, including, but not limited to, nylon, cotton, spandex, linen, silk, or a combination thereof. Undergarment 300 may include an enclosing panel 302 which may extend substantially from a first front side of the undergarment, around the rear of the undergarment, and to a second front side of the undergarment. Enclosing panel 302 may be sized and shaped so as to give undergarment 300 a substantially brief-type configuration. A waistband 312 may be coupled to the top edge of enclosing panel 302.

Coupled to both sides of enclosing panel 302 and extending therebetween may be cover panel 320, the cover panel 320 being disposed substantially at the front center portion of the undergarment. Cover panel 320 may be coupled to enclosing panel 302 at a first side thereof, as well as at the bottom of the crotch area between the leg openings. The top edge of cover panel 320 may be free, in that it is not affixed to any other portion of undergarment 300. Disposed at a second side of cover panel 320 may be a plurality of fasteners 330, which may be snaps, buttons, button apertures, hooks, loops, or the like.

Disposed interiorly of cover panel 320 may be separation panel 340, which may have substantially similar dimensions and shape as cover panel 320. Cover panel 320 may be coupled to enclosing panel 302 at the first and second sides thereof, as well as at the bottom of the crotch area 318 between the leg openings. The top edge of cover panel 320 can further be coupled to waistband 312.

Separation panel 340 may include an opening 342 defined therein. Separation panel 340 may alternatively be formed from two panels having an opening 342 therebetween. Separation panel 340 may further be formed, if desired, from the same material as enclosing panel 302 and cover panel 320. Opening 342 may be shaped as a vertical slot and may be positioned such that, when undergarment 100 is worn, opening 342 can comfortably receive the genitalia of the user therethrough. Furthermore, opening 342 may be selectively openable and may have elastic provided in the sides thereof, to facilitate closure of opening 342 and to provide support and comfort for the user.

Separation panel 340 may further include a plurality of complementary fasteners 332, which may be snaps, buttons, button apertures, hooks, loops, or the like, which may be positioned so as to couple with fasteners 330 of cover panel 320 so as to maintain cover panel 320 in a closed position.

Figure 4A:
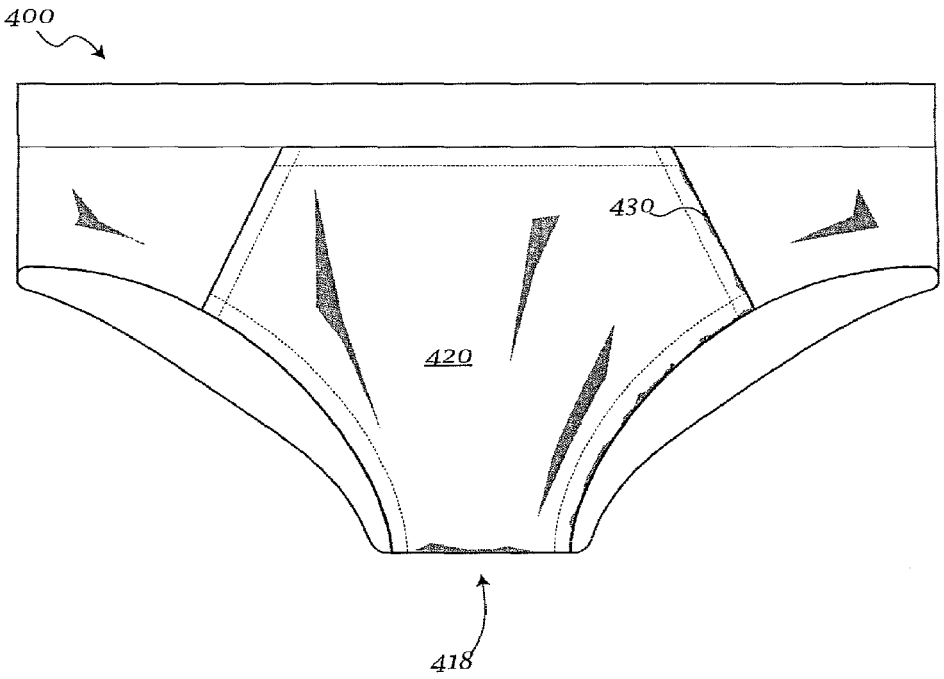
FIG. 4*a* shows a front view of a fourth exemplary embodiment of a male undergarment.
Figure 4B:
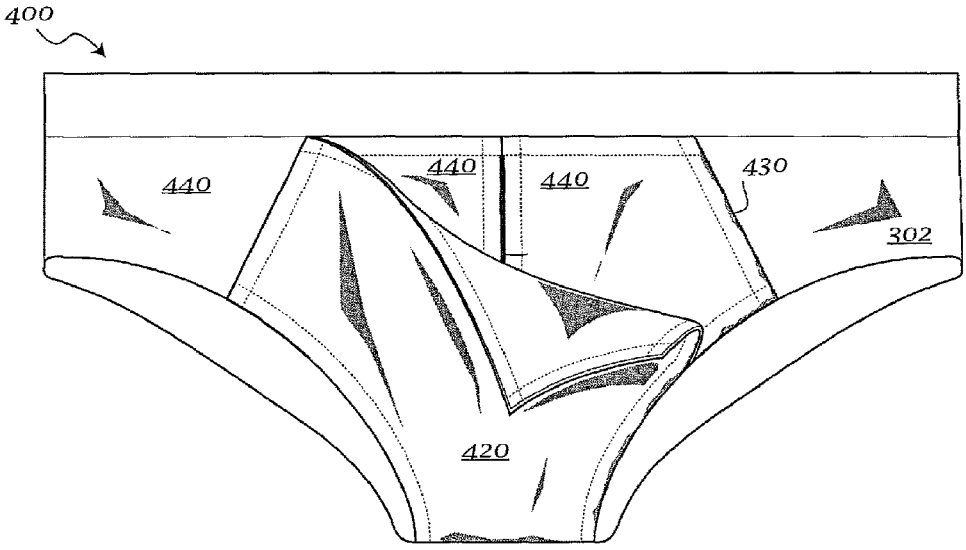
FIG. 4*b* shows a front view of a fourth exemplary embodiment of a male undergarment with the cover panel in an open configuration.
Figure 4C:
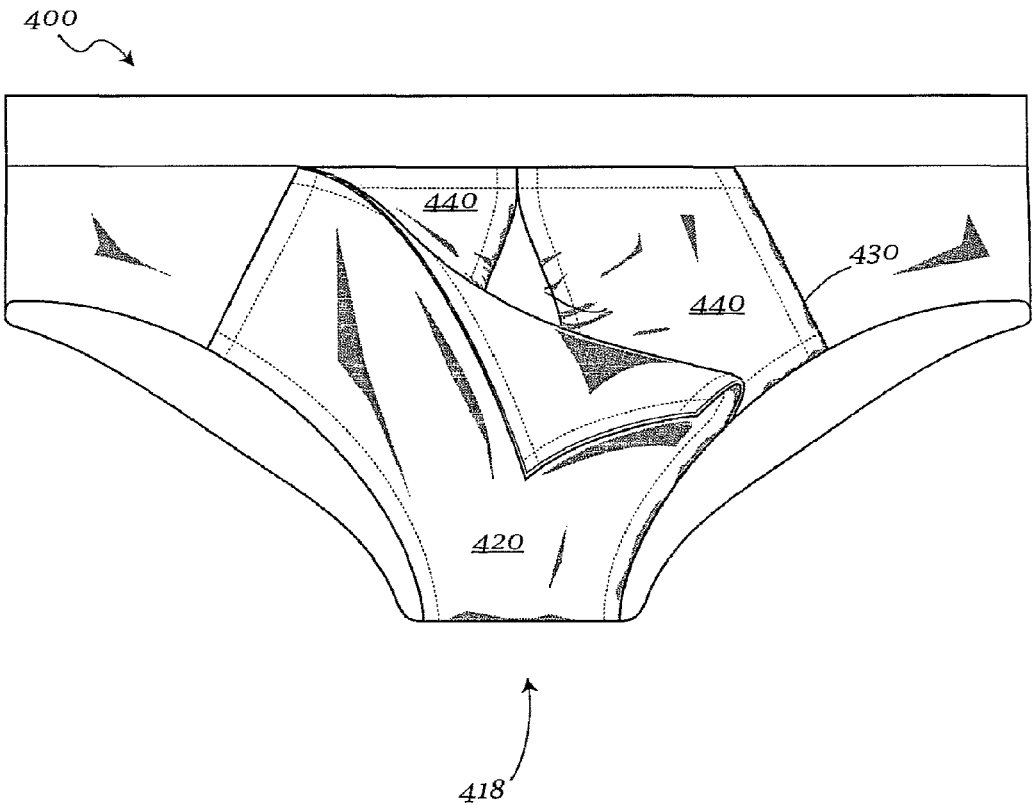
FIG. 4*c* shows a front view of a fourth exemplary embodiment of a male undergarment with the cover panel in an open configuration and the opening in an open configuration.

FIGS. 4*a*-4*c* show another exemplary embodiment of an undergarment 400, which may also be a brief-type undergarment. The features of undergarment 400 that are substantially similar to the features of undergarment 300 are identified by similar numerals in the Figures. Such features should be understood to have substantially similar functionality, while the differences between undergarment 300 and undergarment 400 are further detailed below.

In the embodiment of undergarment 400, the coupling between cover panel 420 and separation panel 440 may be facilitated by a fastener 430, such as, for example, at least one zipper. Furthermore, a lower portion of cover panel 420 may be fixedly coupled to separation panel 440, for example by sewing. Fastener 430 may be concealed, or may have an configuration such that, when cover panel 420 is fastened to separation panel 440, the appearance of a continuous seam, rather than a fastener, is presented therebetween.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A male undergarment, comprising:

at least one enclosing panel having an upper portion, a pair of lower portions spaced from each other and from the upper portion, and a crotch area disposed between the lower portions and spaced from the upper portion;

a front separation panel incorporated by the enclosing panel at a front thereof by extending between a front of the crotch area of the enclosing panel and a front of the upper portion of the enclosing panel and also extending between spaced apart front sides of the enclosing panel extending respectively between the upper portion and the lower portions thereof, the front separation per having an opening for receiving a wearer's genitalia therethrough, the opening being located between the front of the crotch area of the enclosing panel and the front of the upper portion of the enclosing panel and between and spaced from the spaced apart front sides of the enclosing panel; and a front cover panel disposed exteriorly of and overlapping the front separation panel, the front cover panel having a stationary portion permanently coupled to and extending from the front of the crotch area of the enclosing panel toward the front of the upper portion of the enclosing panel, the stationary portion also being coupled at least at one of the spaced apart front sides of the enclosing panel, the coupling extending from the adjacent one of the lower portions of the enclosing panel to the front of the upper portion of the enclosing panel, and a flap portion merging from the stationary portion above the front of the crotch area of the enclosing panel, the flap portion detachably attachable to at least one of the front of the upper portion of the enclosing panel and the other of the spaced apart front sides of the enclosing panel, the flap portion when detached being foldable diagonally across the stationary portion toward the one of the spaced apart front sides of the enclosing panel so as to overlie the stationary portion and substantially expose the opening defined in the front separation panel.

2. The undergarment of claim 1, wherein the opening is annular.

3. The undergarment of claim 2, further comprising:

an elastic material disposed at the periphery of the annular opening.

4. The undergarment of claim 1, wherein the opening is a vertical slit extending between the front of the crotch area of the enclosing panel and the front of the upper portion of the enclosing panel.

5. The undergarment of claim 1, further comprising:

at least one fastener for selectively detachably attaching the flap portion of the front cover panel to at least one of the front of the upper portion of the enclosing panel and the other of the spaced apart front sides of the enclosing panel.

6. The undergarment of claim 5, wherein the at least one fastener is one of a button and a snap.

7. The undergarment of claim 5, wherein the at least one fastener is a zipper.

8. The undergarment of claim 5, wherein the at least one fastener is concealed.

9. The undergarment of claim 1, wherein the separation panel is formed from a material that facilitates aeration of the wearer's genitalia.

10. The undergarment of claim 1, further comprising:

a protective cup disposed between the cover panel and the separation panel.

11. The undergarment of claim 1, wherein at the spaced apart front sides of the enclosing panel are formed spaced apart first and second front seams affixing the front separation panel and at least the stationary portion of the cover panel to the enclosing panel.

12. The undergarment of claim 1, wherein the front separation panel has a size and shape substantially similar to the size and shape of the front cover panel.

13. The undergarment of claim 12, wherein the front separation panel and front cover panel are substantially hexagonal in shape.

14. The undergarment of claim 1, wherein the at least one enclosing panel comprises a first side panel, a second side panel, and a rear panel disposed therebetween.

15. The undergarment of claim 1, further comprising:

a waistband coupled to the at least one enclosing panel and the front separation panel.

16. A male undergarment, comprising:

at least one enclosing panel having an upper waistband, a pair of lower portions spaced from each other and from the upper waistband, and a crotch area disposed between the lower portions and spaced from the upper waistband;

a front separation panel incorporated by the enclosing panel at a front thereof by extending between a front of the crotch area of the enclosing panel and a front of the upper waistband of the enclosing panel and also extending between spaced apart front seams of the enclosing panel extending respectively between the upper waistband and the lower portions thereof, the front separation panel having an opening for receiving a wearers genitalia therethrough, the opening being located between the front of the crotch area of the enclosing panel and the front of the upper waistband of the enclosing panel and between and spaced from the spaced apart front seams of the enclosing panel;

a front cover panel disposed exteriorly of and overlapping the front separation panel, the front cover panel having a stationary portion permanently coupled to and extending from the front of the crotch area of the enclosing panel toward the front of the upper waistband of the enclosing panel, the stationary portion also being coupled at least at one of the spaced apart front seams of the enclosing panel, the coupling extending from the adjacent one of the lower portions of the enclosing panel to the front of the upper portion of the enclosing panel and a flap portion merging from the stationary portion above the front of the crotch area of the enclosing panel, the flap portion detachably attachable to at least one of the front at the upper waistband of the enclosing panel and the other of the spaced apart front seams of the enclosing panel, the flap portion when detached being foldable diagonally across the stationary portion toward the one of the spaced apart front seams of the enclosing panel so as to overlie the stationary portion and substantially expose the opening defined in the front separation panel; and at least one fastener for selectively detachably attaching the flap portion of the front cover panel to at least one of the front of the upper waistband of the enclosing panel and the other of the spaced apart front seams of the enclosing panel.

17. The undergarment of claim 16, wherein the at least one fastener is one of a button and a snap.

18. The undergarment of claim 16, wherein the at least one fastener is a zipper.

19. The undergarment of claim 16, wherein the at least one fastener is concealed.

20. The undergarment of claim 16, wherein the separation panel is formed from a material that facilitates aeration of the wearer's genitalia.

* * * * *